US011339561B2

(12) United States Patent
Ellen

(10) Patent No.: US 11,339,561 B2
(45) Date of Patent: May 24, 2022

(54) METHOD OF CONSTRUCTING A MODULAR BUILDING, A TRAY-LIKE MODULAR BUILDING COMPONENT, AND RELATED METHOD, AND A MODULAR BUILDING COLUMN ASSEMBLY

(71) Applicant: PT Blink Limited, Sydney (AU)

(72) Inventor: Murray Ellen, Lindfield (AU)

(73) Assignee: PT Blink Limited, Sydney (AU)

( * ) Notice: Subject to any disclaimer, the term of this patent is extended or adjusted under 35 U.S.C. 154(b) by 240 days.

(21) Appl. No.: 16/241,050

(22) Filed: Jan. 7, 2019

(65) Prior Publication Data

US 2019/0211542 A1 Jul. 11, 2019

Related U.S. Application Data

(63) Continuation-in-part of application No. PCT/AU2017/000146, filed on Jul. 5, 2017.

(30) Foreign Application Priority Data

Jul. 6, 2016 (AU) ..... 2016902651

(51) Int. Cl.

| | |
|---|---|
| ***E04B 1/16*** | (2006.01) |
| ***E04B 5/40*** | (2006.01) |
| ***E04G 13/02*** | (2006.01) |
| ***E04G 21/12*** | (2006.01) |

(52) U.S. Cl.

CPC ..... *E04B 1/161* (2013.01); *E04B 5/40* (2013.01); *E04G 13/02* (2013.01); *E04G 21/12* (2013.01)

(58) Field of Classification Search

CPC . E04B 1/04; E04B 1/161; E04B 1/163; E04B 1/164; E04B 2/86; E04B 5/40; E04B 5/43; E04G 13/02; E04G 21/12

USPC ..... 52/79.1

See application file for complete search history.

(56) References Cited

U.S. PATENT DOCUMENTS 938,458 A * 11/1909 Brockhausen ..... E04B 5/43 52/283
1,380,324 A * 5/1921 Piggins ..... E04B 1/215 52/283
1,496,819 A * 6/1924 Mitchell ..... B28B 23/18 264/35
2,871,544 A * 2/1959 Youtz ..... E04B 1/35 52/745.13

(Continued)

FOREIGN PATENT DOCUMENTS

EP 2752528 A1 7/2014

OTHER PUBLICATIONS

International Search Report and Written Opinion dated Oct. 3, 2017 in connection with PCT/AU2017/000146.

(Continued)

*Primary Examiner* — Brian E Glessner
*Assistant Examiner* — James J Buckle, Jr.
(74) *Attorney, Agent, or Firm* — Cook Alex Ltd.

(57) ABSTRACT

A method of constructing a modular building, the method can include the following sequential steps: constructing a multi-floor building frame by connecting a plurality of like open topped-trays and column assemblies, with the trays forming floors and the column assemblies separating the floors; assembling walls or walls formwork to the frame; and pouring wet concrete into the trays to form the building.

17 Claims, 16 Drawing Sheets

(56) References Cited

U.S. PATENT DOCUMENTS 3,490,191 A * 1/1970 Ekblom ..... E04B 1/20 52/745.13
3,524,293 A * 8/1970 Leyten ..... E04G 17/06 52/745.13
3,613,325 A * 10/1971 Yee ..... E04B 1/20 52/236.8
3,757,477 A * 9/1973 McCrillis ..... E04B 1/348 52/79.1
3,768,221 A * 10/1973 Fuller ..... E04B 1/348 52/220.2
3,800,493 A * 4/1974 Livingston ..... E04B 1/34869 52/745.03
3,805,467 A * 4/1974 McCrillis ..... E04B 1/04 52/264
4,338,759 A 7/1982 Swerdlow et al.
4,607,470 A 8/1986 Ecker
4,807,407 A * 2/1989 Horn ..... E04B 1/24 52/125.2
5,207,045 A * 5/1993 Bodnar ..... E04B 5/29 52/600
5,669,197 A * 9/1997 Bodnar ..... E04B 1/161 52/600
5,867,964 A 2/1999 Perrin
6,293,063 B2 * 9/2001 Van Doren ..... E04B 1/165 52/250
6,493,996 B1 * 12/2002 Alexander ..... E04B 1/34823 52/234
7,353,642 B1 * 4/2008 Henriquez ..... E04B 1/161 52/338
7,779,600 B1 * 8/2010 Saebi ..... E04B 1/161 52/745.19
8,418,411 B2 * 4/2013 Garcia ..... B28B 7/22 52/79.1
8,549,805 B2 * 10/2013 Kim ..... E04C 5/0645 52/260
8,844,223 B2 * 9/2014 Zhong ..... B28B 19/0053 52/259
9,038,339 B2 * 5/2015 Zhong ..... E04B 1/165 52/259
10,260,224 B1 * 4/2019 Jazzar ..... E04G 11/48
10,760,260 B2 * 9/2020 Yin ..... E04B 1/04
2005/0066592 A1 * 3/2005 Huber ..... E04G 9/05 52/169.9
2005/0155297 A1 * 7/2005 Aburto Ponce ..... E04B 1/161 52/79.1
2005/0204687 A1 * 9/2005 Raftery ..... E04B 1/3404 52/741.1
2009/0151298 A1 * 6/2009 Jazzar ..... E04B 1/34823 52/745.05
2010/0058675 A1 * 3/2010 Simmons ..... E04B 1/34807 52/79.1
2011/0047928 A1 * 3/2011 Aburto ..... E04B 1/161 52/745.05
2011/0088348 A1 * 4/2011 Rahimzadeh ..... E04B 5/43 52/649.2
2011/0131908 A1 * 6/2011 Lee ..... E04B 5/023 52/283
2012/0047816 A1 * 3/2012 Zhong ..... E04B 1/164 52/11
2012/0167501 A1 * 7/2012 Tikhovskiy ..... E04B 1/04 52/251
2012/0167502 A1 * 7/2012 Tikhovskiy ..... E04B 5/29 52/251
2013/0047539 A1 * 2/2013 Katsalidis ..... E04B 1/161 52/432
2013/0074430 A1 * 3/2013 Morcous ..... E04B 5/265 52/252
2014/0000207 A1 * 1/2014 Rahimzadeh ..... E04B 1/30 52/650.3
2014/0298745 A1 * 10/2014 Rechenmacher ..... E04B 1/165 52/425
2015/0059267 A1 * 3/2015 Zhong ..... E04G 9/05 52/204.1
2015/0191922 A1 * 7/2015 Giat ..... E04G 17/02 264/31
2016/0122996 A1 * 5/2016 Timberlake ..... E04C 5/0604 52/236.3
2018/0355600 A1 * 12/2018 Yang ..... E04B 1/24
2019/0078314 A1 * 3/2019 Yin ..... E04B 1/20

OTHER PUBLICATIONS

International Preliminary Report on Patentability dated Jan. 8, 2019 in connection with PCT/AU2017/000146.
Examination Report dated Feb. 26, 2019 in connection with Australian application No. 2017293646.

* cited by examiner

METHOD OF CONSTRUCTING A MODULAR BUILDING, A TRAY-LIKE MODULAR BUILDING COMPONENT, AND RELATED METHOD, AND A MODULAR BUILDING COLUMN ASSEMBLY

CROSS-REFERENCE TO RELATED APPLICATIONS

This application is a continuation-in-part of International Application No. PCT/AU2017/000146 having an international filing date of Jul. 5, 2017 entitled "A Method of Constructing a Modular Building, a Tray-Like Modular Building Component, and Related Method, and a Modular Building Column Assembly". The '146 international application claimed priority benefits, in turn, from Australian Patent Application No. 2016902651 filed on Jul. 6, 2016. The '146 international application is hereby incorporated by reference herein in its entirety.

FIELD OF THE INVENTION

The present invention relates to method of constructing modular buildings, tray-like modular building components, related methods, and/or related modular building column assemblies.

Any discussion of the prior art throughout the specification should not be considered as an admission that such prior art is widely known or forms part of the common general knowledge in the field.

Multi-story building structures are typically made from concrete and/or steel, with timber being used as formwork. Generally, when constructing these buildings, framework is formed to provide the basis for columns and floors structures, with concrete and steel being formed within or adjacent to the framework to define the building. The construction process is generally limited to floor-by-floor to provide a rigid structure upon which to build additional floors.

For medium to high rise building structures, often a concrete core for the lift shafts needs to be constructed prior to floors being built to provide stability and trueness of shape to the building structure. The equipment to build the core lift shafts is expensive and this process can delay when finishing trades can commence.

Further, finishing trades, such as plumbing, rendering, electrical and sanitary must wait until the building structure is complete and the concrete is strong enough to commence their work. Finishing trade work can represent a significant proportion of the total time it takes on a building construction project.

As a result, some designers and builders have begun fabricating large elements, as much as possible off site in factory conditions, and then bringing them to site for assembly. This often includes pre-assembled rooms that can be cumbersome to transport and/or deliver and "box-like" in appearance which doesn't lend them to architectural flexibility.

Additionally, buildings must be fire resistant for occupational safety and code compliance. Traditionally this means that buildings are constructed from non-combustible materials, such as concrete, or are treated on site with a fire retardant system.

There is a need to reduce construction times for multi-story buildings and provide architectural flexibility.

It is an object of the present invention to address the above need and/or at least substantially overcome or at least ameliorate one or more of the above disadvantages.

SUMMARY OF THE INVENTION

In some embodiments, a method is provided for constructing a modular building. In some embodiments, the method can include the following steps: constructing a multi-floor building frame by connecting a plurality of like open topped-trays and column assemblies, with the trays forming floors and the column assemblies separating the floors; assembling walls or walls formwork to the frame; and pouring wet concrete into the trays to form the building. In some embodiments, the steps are sequential.

In at least some embodiments, the column assemblies are preferably hollow and the wet concrete is poured therethrough. In at least some embodiments, the walls formwork is preferably hollow and the wet concrete is poured therethrough.

In at least some embodiments, a roof structure is preferably assembled to the frame. In at least some embodiments, the roof structure is preferably assembled to the frame prior to the pouring of the wet concrete.

In some embodiments, wet concrete is poured into all of the trays and then allowed to cure. In some embodiments, wet concrete is poured into some of the trays and allowed to cure, and then wet concrete is poured into the remainder of the trays, and the remainder is then allowed to cure. In some embodiments, wet concrete is poured into the trays progressively and the trays are progressively allowed to cure.

In some embodiments, the trays are preferably tensioned before being constructed into the frame to deform the trays, where after the filling of the trays with concrete flattens the trays and induces post tensioning strengthening therein.

In some embodiments, bracing is preferably attached the exterior of the modular building.

In some embodiments, a tray-like modular building component adapted for filling with concrete after assembly with like components into a building frame can include: a substantially rectangular frame with a pair of opposed sides and a pair of opposed ends defining an interior therebetween; a sheet mounted to the frame and extending over the interior; a pair of beams, each mounted to the frame along each one of the pair of sides respectively; and/or a pair of end plates, each mounted to the frame along each one of the pair of ends respectively, wherein the sheet, the beams and the end plates together form an open-topped tray for receiving the concrete therein.

In some embodiments, the tray-like modular building component preferably includes a pair of tensioners, each mounted to and along each one of the pair of beams respectively, wherein the tensioners are adapted for tensioning the beams to deform the beams and the sheet.

In some embodiments, the tray-like modular building component preferably includes a plurality of deflector plates placed along each side beam, each deflector plate configured to allow the tensioner to pass therethrough, whereby tensioning of the tensioners engages the deflector plates and deforms the beams.

In some embodiments, the tensioner is preferably pre-tensioned utilizing a barrel and wedge assembly.

In some embodiments, the tray-like modular building component preferably includes a reinforcing mesh part mounted to the frame above the interior.

In some embodiments, a method of constructing a tray-like modular building component adapted for filling with concrete after assembly with like components into a building frame can include the following steps: assembling a substantially rectangular frame with a pair of opposed sides and a pair of opposed ends defining an interior therebetween; mounting a sheet to the frame which extends over the interior; mounting a pair of beams to the frame, each along each one of the pair of sides respectively; mounting a pair of end plates to the frame, each along each one of the pair of ends respectively; and/or forming an open-topped tray for receiving the concrete therein from the sheet, the beams and the end plates.

In some embodiments, the method preferably includes: mounting a pair of tensioners to the beams, each to and along each one of the pair of beams respectively; and/or tensioning the beams by adjusting the tensioners and thereby deforming the beams and the sheet.

In some embodiments, the method preferably includes placing a plurality of deflector plates along each side beam, each deflector plate configured to allow the tensioner to pass therethrough, whereby tensioning of the tensioners engages the deflector plates and deforms the beams.

In some embodiments, the tensioner is preferably pre-tensioned utilising a barrel and wedge assembly.

In some embodiments, the method includes mounting a reinforcing mesh part to the frame above the interior.

In some embodiments, a modular building column assembly adapted for filling with concrete after assembly with like components into a building frame can include: a column part with an open top end, an open bottom end and a hollow interior therebetween; at least one joiner part, with a hollow interior, extending at least partially into the column interior in an overlapping relationship with the top end or the bottom end; and/or at least one fastener extending through the column part and the joiner part where they overlap so as to fix the column part to the joiner part; wherein the interior of the column part and the interior of the joiner part are in fluid communication with each other so as to allow wet concrete to flow from one to the other.

In some embodiments, the modular building column assembly preferably includes a pair of parallel and spaced apart column parts with a reinforcing mesh part therebetween.

BRIEF DESCRIPTION OF DRAWINGS

Preferred embodiments are described hereinafter, by way of examples only, with reference to the accompanying drawings.

DETAILED DESCRIPTION OF PREFERRED EMBODIMENT(S)

Figure 1:
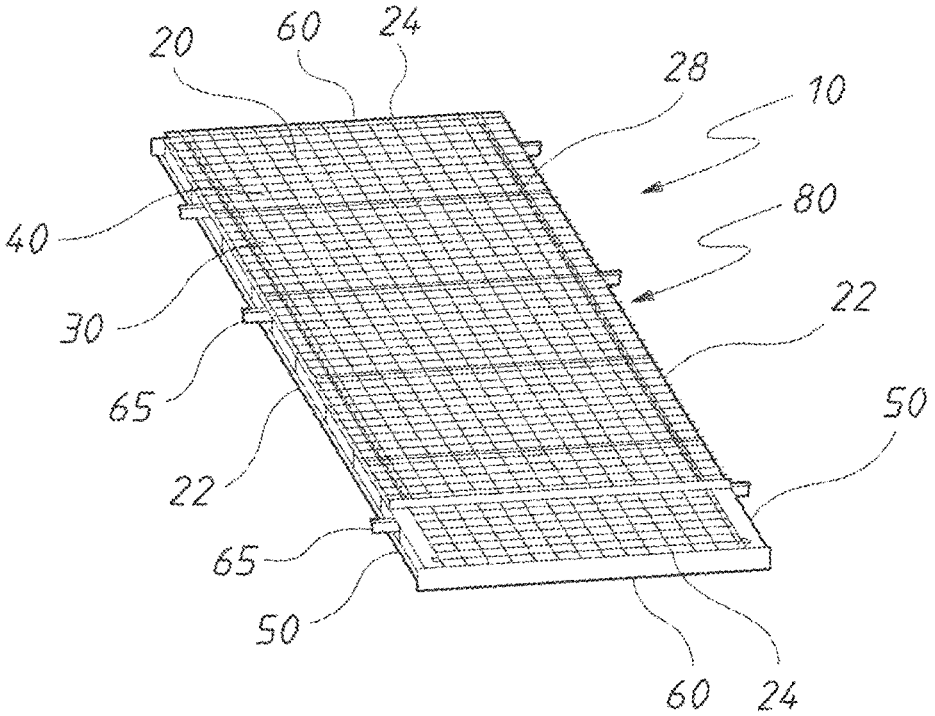
FIG. 1 is a perspective view of a single tray for use in a first embodiment of a building frame.
Figure 2:
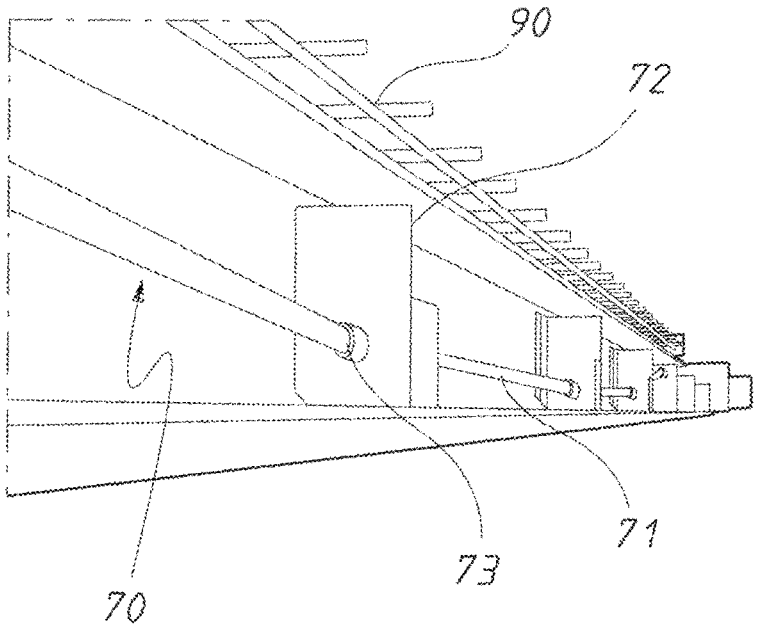
FIG. 2 is a perspective view of a tensioning system of the tray shown in FIG. 1.
Figure 3:
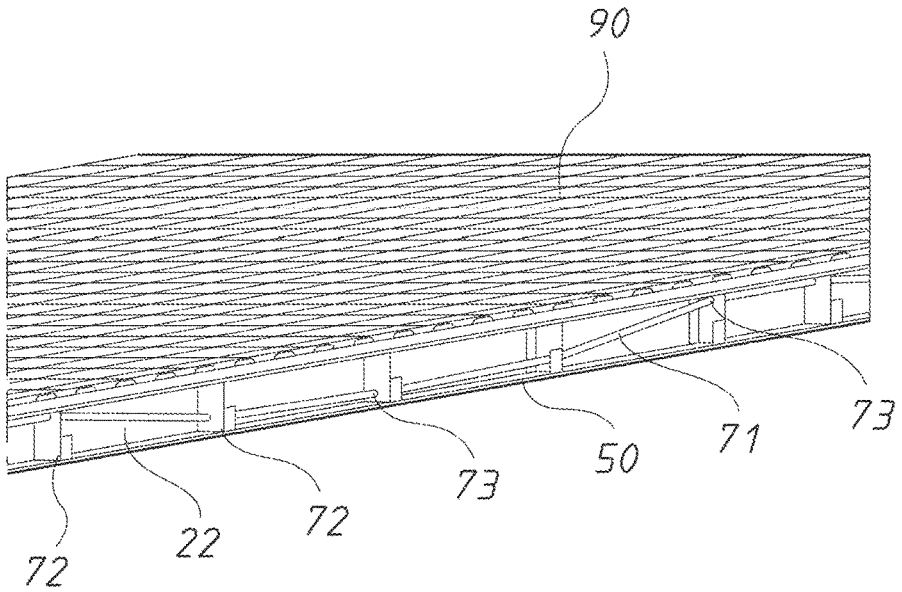
FIG. 3 is a further perspective view of the tensioning system of the tray shown in FIG. 1.

Tray-like modular building component 10 (hereafter tray 10) according to a first embodiment is depicted in FIGS. 1 to 3. Tray 10 is part of an assembly to construct a first embodiment of building frame 300 (See FIG. 11) adapted for filing with concrete to build a modular building (See FIG. 12). In at least some embodiments, tray 10 comprises substantially rectangular frame 20 having a pair of opposed sides 22 and a second pair of opposed sides 24 defining interior 30 therebetween.

In at least some embodiments, tray 10 is rectangular shaped, although various other forms of tray 10 are possible, such as stepped ends, to define a balcony, or having significant portions removed, to define lift shafts of a building frame. In at least some embodiments, tray 10 can also have shaped ends for architectural intent to be expressed.

In some embodiments, frame 20 is manufactured to a length of between 12 to 14 metres and a width of 2½ to 3½ metres. In some embodiments, frame 20 can be assembled using tie straps 28 with or without turn buckles. In at least some embodiments, tie straps 28 provide a mechanism for tensioning and strengthening frame 20. In some embodiments, tie straps 28 can be tightened to get a width-wise camber into frame 20 that is intended to flatten when countering the weight of the wet concrete that can be added to frame 20 during construction.

In some embodiments, tray 10 also includes sheet 40 mounted to frame 20 that extends over interior 30. In some embodiments, sheet 40 is standard form sheeting made from steel or other suitable materials. In some embodiments, sheet 40 is mounted to frame 20 using a suitable mounting method, such a fastening or gluing. In some embodiments, sheet 40 can support the weight of concrete when constructing the modular building.

In at least some embodiments, tray 10 also comprises a pair of beams 50. In some embodiments, beams 50 are standard I-beams. In some embodiments, each beam 50 is mounted to the frame along each one of the pair of sides 22 respectively. In at least some embodiments, frame 20 and sheet 40 attach to and sit within a lower flange of each of beams 50 and are secured thereto using suitable fastening means, such as screws or shot fired rivets. In at least some embodiments, beams 50 are manufactured using steel, however, other materials capable of the deformation and strength requirements for constructing a building are suitable.

In at least some embodiments, tray 10 comprises a pair of end plates 60, where each end plate 60 is mounted to frame 20 along each one of the pair of ends 24 respectively. In at least some embodiments, end plate 60 is secured to frame 20. In at least some embodiments, a plurality of standard attachment brackets can be used to secure end plates 60 to frame 20.

In at least some embodiments, tray 10 includes a pair of tensioners 70. The tensioners can be cables 71 comprised of a plurality of steel strands. In at least some embodiments, cable 71 can be fed through deflector plates 72 attached to beams 50. In at least some embodiments, deflector plates 72 are mounted to and along each one of the respective beams 50 respectively and together with the cable. In at least some embodiments, deflector plates 72 include aperture 73 configured to allow cable 71 to pass therethrough. In at least some embodiments, the location of the aperture 73 in deflector plate 72 is variable in order to provide the deformation characteristics required for tray 10. That is, as illustrated in FIGS. 2 and 3, cable 71 passes through apertures 73. In at least some embodiments, profile cable 71 is configured so that when tensioning cable 73, a force is applied into deflector plates 72 that causes deflector plates 72 to engage with beams 50 and sheet 40 to deform beams 50 and sheets 40 into a desired deformation profile. The amount and degree to which the deformation occurs depends on the size of tray 10 and the expected weight of the concrete to be added on site in order to construct the building.

In at least some embodiments, at the manufacturing stage, sheet 40, beams 50 and end plates 60 together form open-top tray 80 for receiving the concrete therein. In at least some embodiments, open-top tray 80 can be manufactured in a factory offsite. In at least some embodiments, tray 80 is designed to fit on the back of standard trucks for transportation to the building site. At this stage in the manufacturing process, assembled open-top tray 80 is produced that forms the basis for tray 10. However, as mentioned, cables 71 are adapted for tensioning so that beams 50 and sheet 40 are deformed. In at least some embodiments, this deformation is designed to counteract the weight of the wet concrete and post-tension tray 10 upon adding and setting of the concrete.

Figure 4:
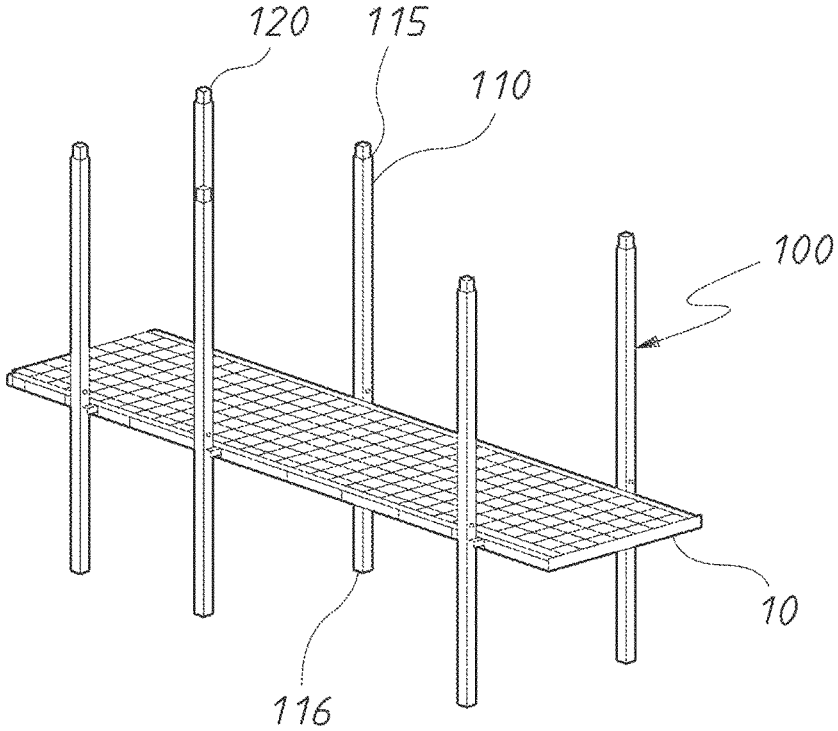
FIG. 4 shows the tray of FIG. 1 installed adjacent a plurality of building frame columns for a first embodiment of a building frame.

FIG. 4 shows an exemplary deformation profile, relative to a dashed horizontal reference line, in which the (cantilever) end of tray 10 is deflected upwards by 'd' and the middle of tray 10 (between adjacent columns 100) is deflected upward by 'D'.

In at least some embodiments, cable 71 is pre-tensioned utilising a barrel and wedge assembly (not shown) by gripping an end of cable 71 adjacent the barrel and wedge assembly and pulling the cable through the barrel and wedge assembly, which bears against end plate 60.

In at least some embodiments, force is applied to beams 50 in the factory and is load balanced therein. In at least some embodiments, the force creates the deformation in beam 50, like pre and post-tensioned concrete. In the field of stressing there are traditionally two sorts: pre-stressing; and post-tensioning. Pre-stressing applies load to the cable prior to concrete being placed and then on release of the tension the load is transferred to the concrete. Post-tensioning leaves a duct within the concrete and the force is applied, after the concrete is set, by external jacks. In at least some embodiments, the duct is then grouted or filled with grease. In some embodiments, such as those depicted in the accompanying drawings, there is no duct, but rather the concrete surrounds the cable during pouring, flattening the tray to create a flat surface for the floor. This will be described below with reference to FIG. 13. Live loads alone are resisted by tray 10, but not the dead load, as in traditional approach. Further, in at least some embodiments, once the concrete is poured, cable 71 is protected from fire, and can be designed as a fire rated steel member, with no further treatment.

Either in the factory or on-site, additional floor penetrations and/or service conduits can be installed to tray 10. In at least some embodiments, additional conduits, such as plumbing, electrical, sanitary, etc., can be installed easily and quickly onto tray 10 before assembling the building frame. The conduits can then easily assembly together to form the full conduit necessary prior to concrete being added, aiding in installation time for the remaining services to commence.

In at least some embodiments, fire boards, which protect steel prone to heat, are also fitted in the factory, prior to delivery to site. As a result, costly site work is avoided. This, combined with the act of pouring concrete designed to encase steel beams, provides a fire-resistant steel structure.

In at least some embodiments, such as seen in FIG. 2, tray 10 can include reinforcing mesh part 90 mounted to frame 20 that is positioned above interior 30. In at least some embodiments, standard reinforcing mesh used in standard concreting applications is used. Depending on the number of trays 10 required to form a floor of a building, mesh 90 can span only one tray 10, or several trays 10 as part of the assembly.

In at least some embodiments, tray 10 has outwardly extending flanges 65 configured to attach to columns 100 to form building frame 300.

Figure 6:
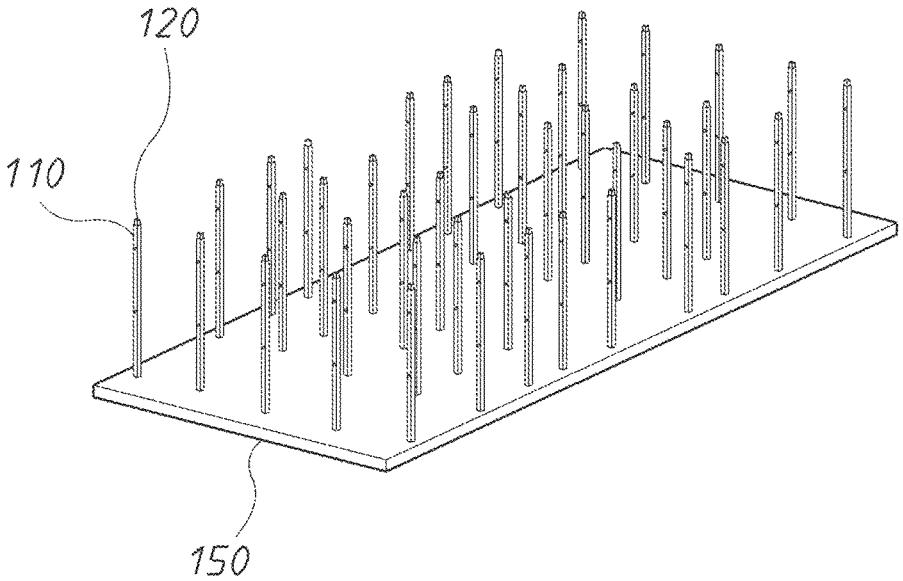
FIG. 6 is a perspective view of a plurality of the building frame columns, used to form ground and first floor walls of the first embodiment of the building frame.
Figure 7:
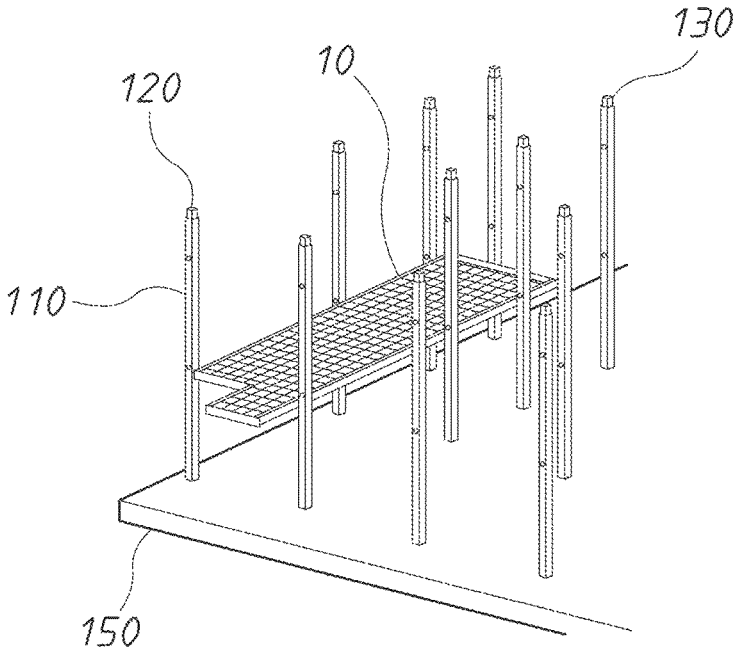
FIG. 7 is a close up view of the tray shown in FIG. 1 used to form the first floor of the first embodiment of the building frame with the columns shown in FIG. 6.
Figure 11:
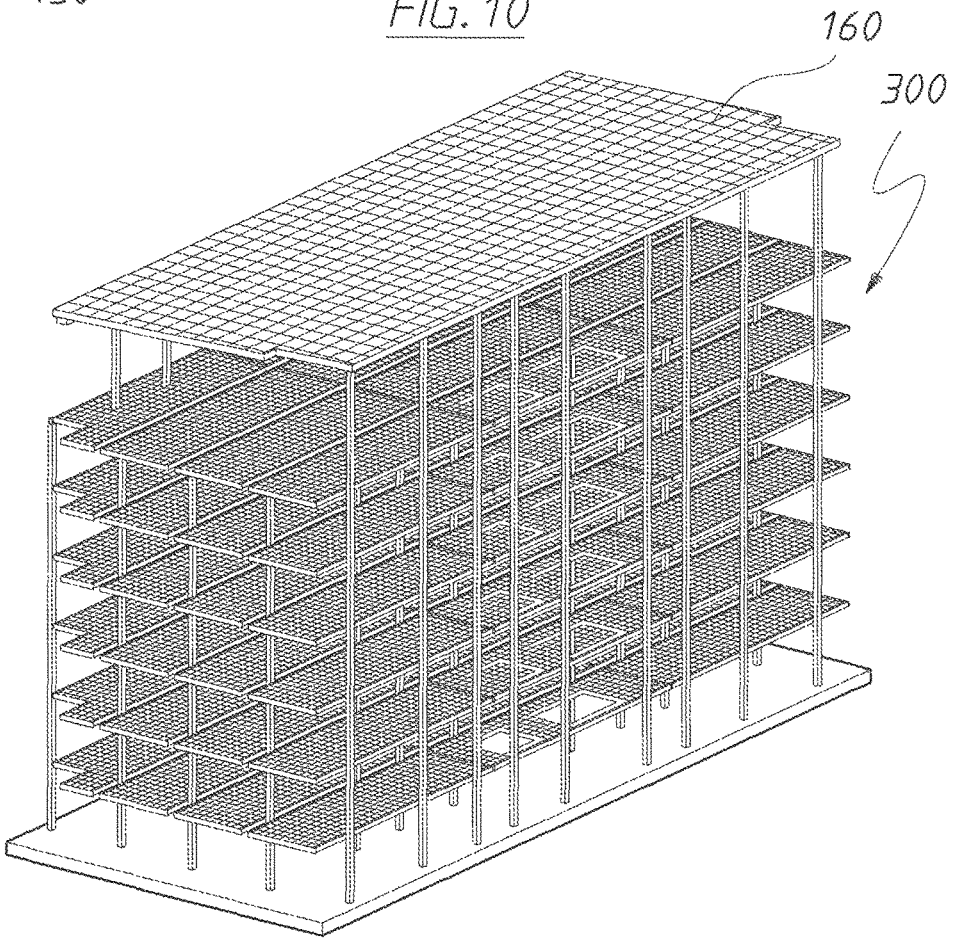
FIG. 11 shows multiples of the trays shown in FIG. 1 used to form the completed six floor first embodiment of the building frame with the columns shown in FIG. 6, with the wall formwork not shown.

Modular building column assembly 100 according to a second embodiment is depicted in FIG. 6. In at least some embodiments, modular building column assembly 100 is adapted for filling with concrete after assembly with like components into building frame 300. In some embodiments, individual column assembly 100 includes column part 110 with open top end 115, open bottom end 116 and a hollow interior therebetween. FIG. 4 shows six column parts 110 arranged about tray 10. Upwardly extending from open top end 115 of column part 110 is at least one joiner part 120. In some embodiments, joiner part 120 has a hollow interior and is configured to extend at least partially into the interior of column part 110 in an overlapping relationship. In some embodiments, joiner part 120 extends from the top end of one column part 110 and, when assembling the building frame, joins the bottom end of another column part 110. FIG. 11 illustrates the overlapping intersection of column parts 110 to form a plurality of column parts 110 joined together by joiner part 120. In some embodiments, column part 110 and joiner part 120 are made from steel.

In some embodiments, column assembly 100 includes at least one fastener 130 extending through column part 110 and joiner part 120 where they overlap so as to fix column part 110 to joiner part 120. In at least some embodiments, fastener 130 is a standard nut and bolt arrangement, however, due to the hidden nature of the interior of the joiner part, in some embodiments, blind fasteners can be required. In at least some embodiments, interior of the column part 110 and the interior of joiner part 120 are in fluid communication with each other to allow the concrete to flow from one to the other during construction of the building. In at least some embodiments, column parts 110 and joiner parts 120 are designed to be manufactured in a factory from traditionally available materials but assembled in the manner disclosed herein. Internal walls can be placed immediately after concreting, using conventional or proprietary systems.

Figure 8:
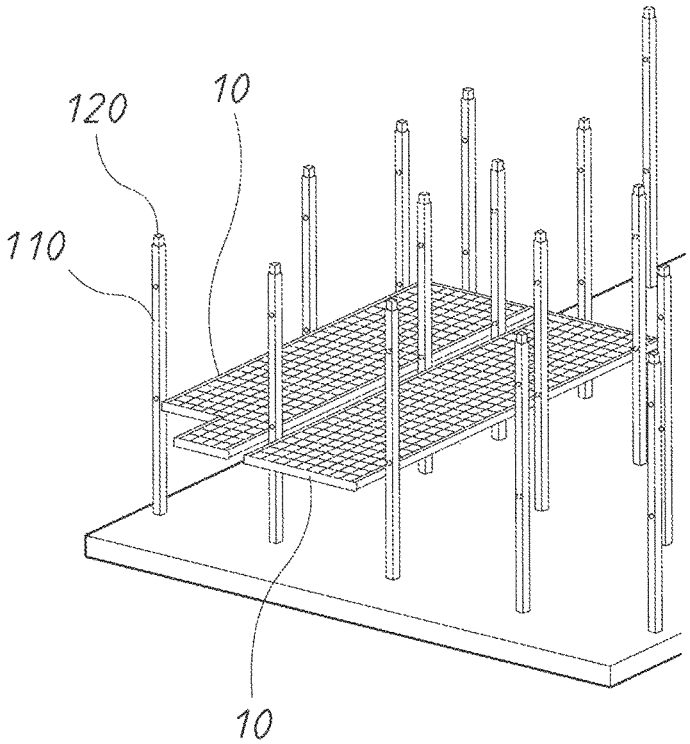
FIG. 8 shows multiples of the trays shown in FIG. 1 used to form the first floor of the first embodiment of the building frame with the columns shown in FIG. 6.
Figure 9:
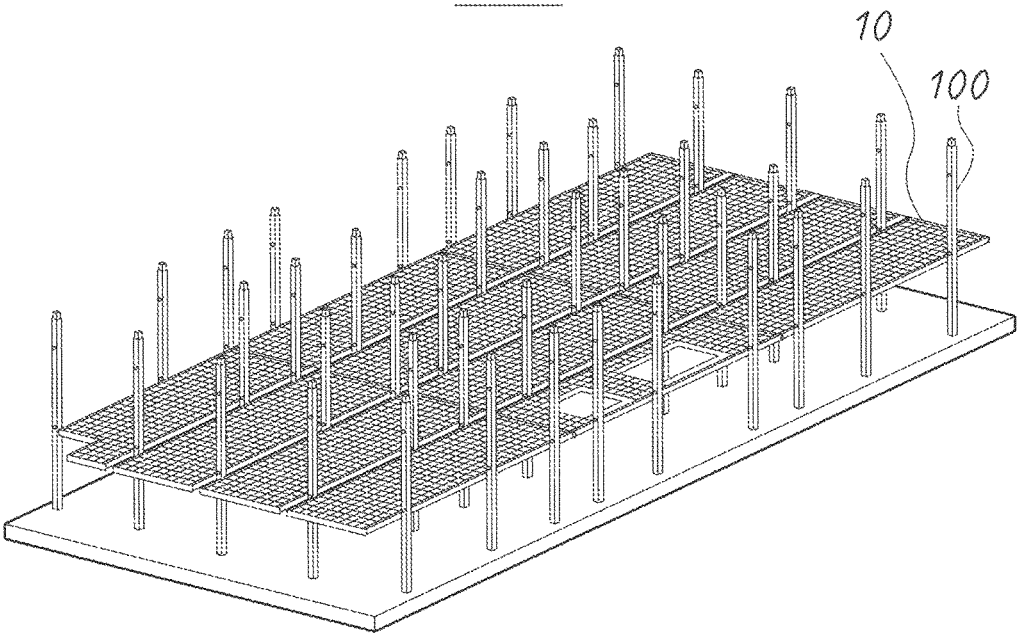
FIG. 9 shows multiples of the trays shown in FIG. 1 used to form the first floor of the first embodiment of the building frame with the columns shown in FIG. 6.
Figure 10:
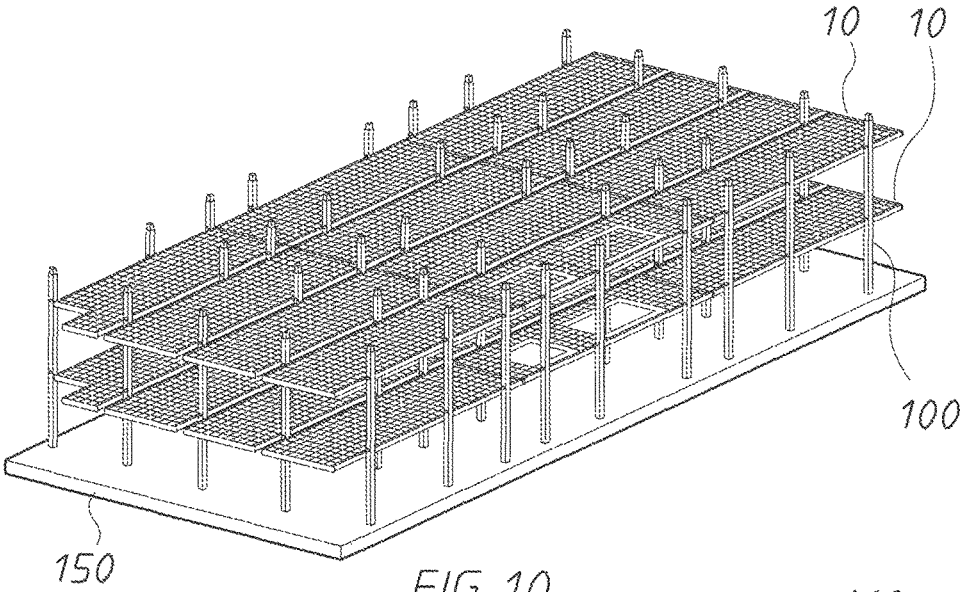
FIG. 10 shows multiples of the trays shown in FIG. 1 used to form the first and second floors of the first embodiment of the building frame with the columns shown in FIG. 6.

In at least some embodiments, a plurality of column parts 110 can form the building frame for a first floor, as illustrated in FIG. 8. In at least some embodiments, tray 10 can be attached to column part 110 by flanges 65. In at least some embodiments, the arrangement suitable for the first floor can be re-constructed for additional floors. FIGS. 9 to 11 shows a plurality of different trays 10 attached to a plurality of column assemblies 100 where some of trays 10 have open sections to allow for lift shaft and the balcony extending from the frame.

In at least some embodiments, there are single columns 100 and double columns 100, depending on the structural requirements of the building. The single and double columns 100 can contain reinforcement to assist in fire resistance. The double columns act to brace the building as it is installed.

Figure 12:
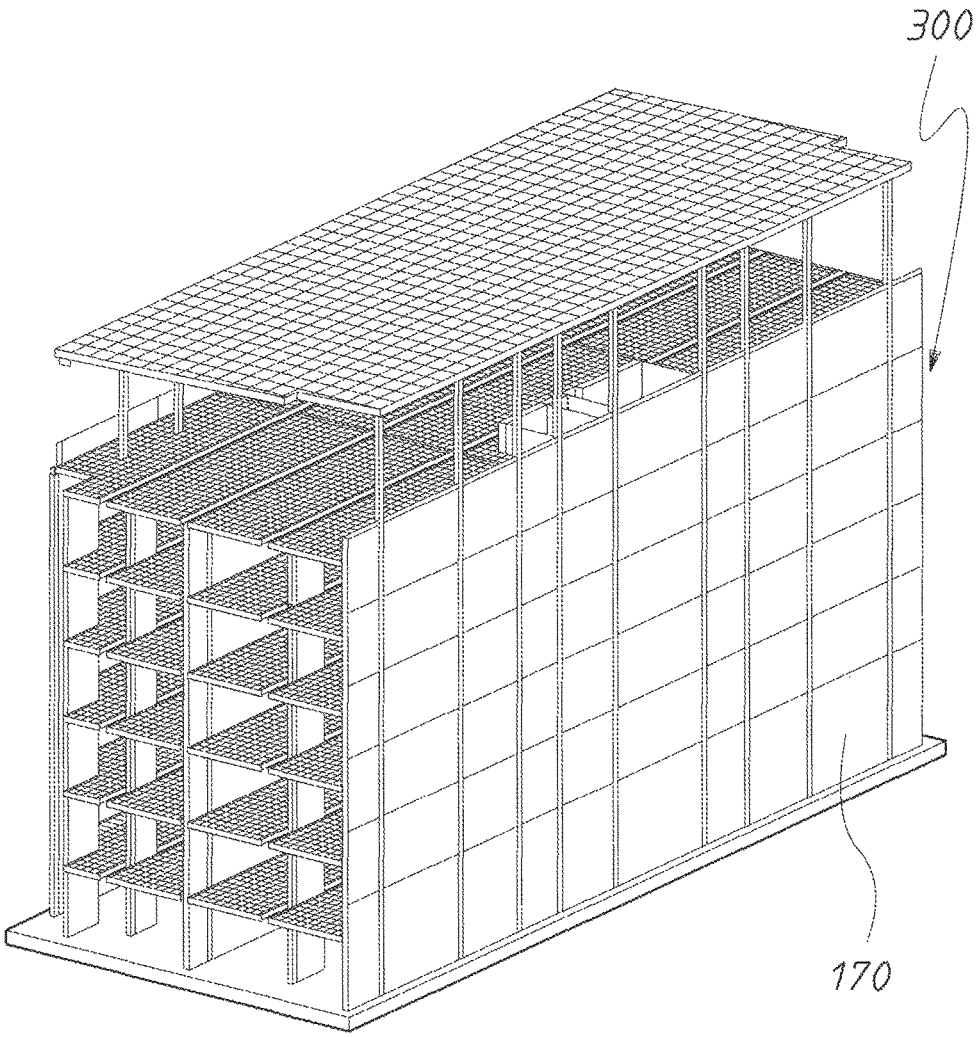
FIG. 12 shows multiples of the trays shown in FIG. 1 used to form the completed six floor first embodiment of the building frame with the columns shown in FIG. 6, with the wall formwork.

In at least some embodiments, a multi-floor building frame, such as ones depicted in FIGS. 9 to 12, is constructed using the following steps. In at least some embodiments, the steps are sequential. The frame connects a plurality of like open topped trays or components 10 and like hollow column assemblies 100, with components 10 forming floors and column assembly's 100 separating the floors. In at least some preferred embodiments, column assemblies 100 are inserted to base 150 and components 10 are attached to column assemblies 100. In at least some embodiments, this process is repeated for as many floors that are required for the overall modular building to produce finished building frame 300. In at least some embodiments, roof structure 160 can be assembled and walls 170 providing the form work can be added to the frame. This is illustrated in FIGS. 11 and 12. In at least some embodiments, form work for walls 170 is standard timber with a hollow center for receiving concrete. In at least some embodiments, pouring wet concrete into the trays and through the columns to form the building and into the wall form work can be conducted in one action and produces uniform sections that join columns and floors. In some embodiments, the concrete can be poured into the trays, columns and wall formwork as separate actions. In some embodiments, walls 170 can be made (pre-cast) in a factory. In some of these embodiments, wet concrete is only required to be poured into the trays and columns.

Figure 5:
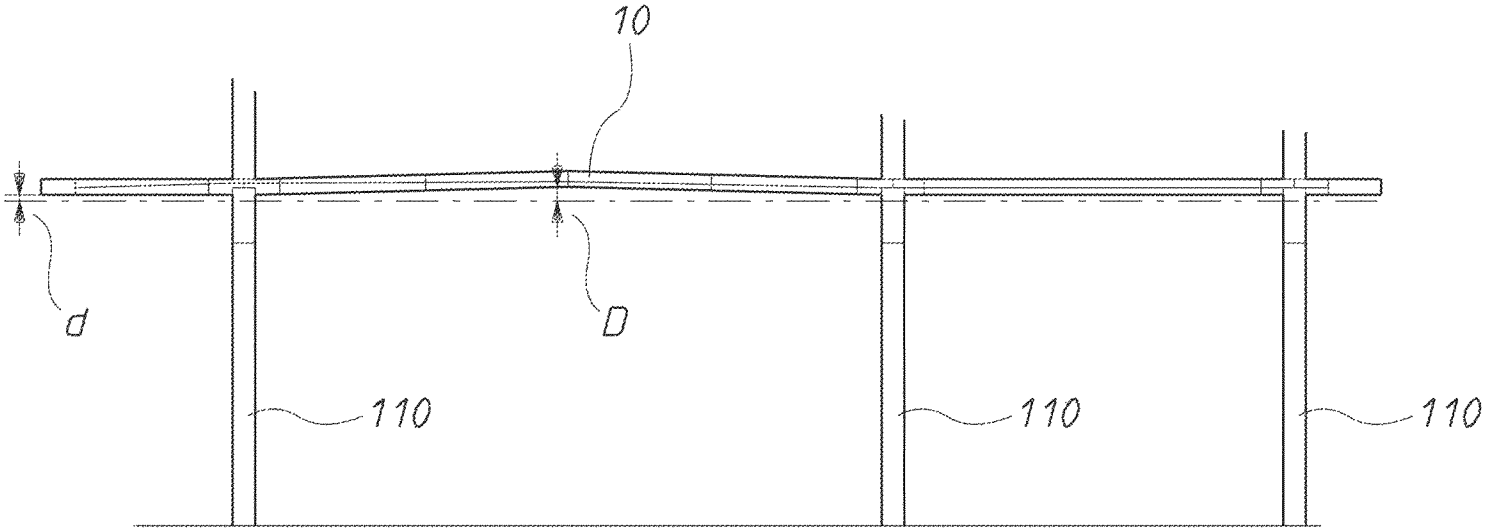
FIG. 5 shows a cross section of the tray in FIG. 4.
Figure 13:
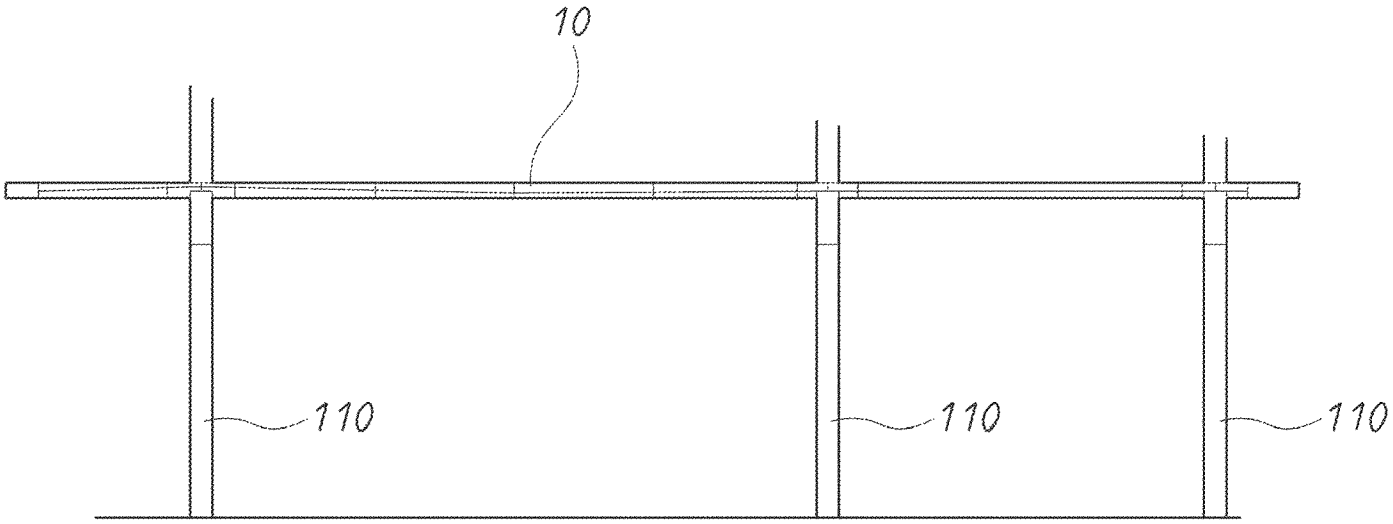
FIG. 13 shows the tray in FIG. 5, after filling with concrete.

In some embodiments, trays 10 can be pretensioned using tensioners 70 and tie straps 28 to form a deformed shape, such as shown in FIG. 5. In at least some embodiments, filling trays 10 with concrete then flattens trays 10, as shown in FIG. 13, and provides post tensioning strengthening therein.

In some embodiments, the method of manufacturing multi-story buildings in a factory in such a way as described herein allows construction times can be halved. This means a typical twenty-unit apartment building can be built in six-months in first world countries. Project funding requirements are therefore significantly less and income streams from sales are received much earlier. This significantly benefits the economics of projects.

In at least some embodiments, building frame 300 is stable and does not need a core to maintain trueness during installation. The core for the lift shaft can be installed after the building has reached its maximum height. There are similar material costs to conventional methods, but by halving construction time it reduces the preliminaries and overheads also by half.

FIGS. 14 to 21 show a second embodiment of building frame 400. Like reference numerals to those used to indicate feature of first frame 300 are used to denote like features in second frame 400.

Figure 14:
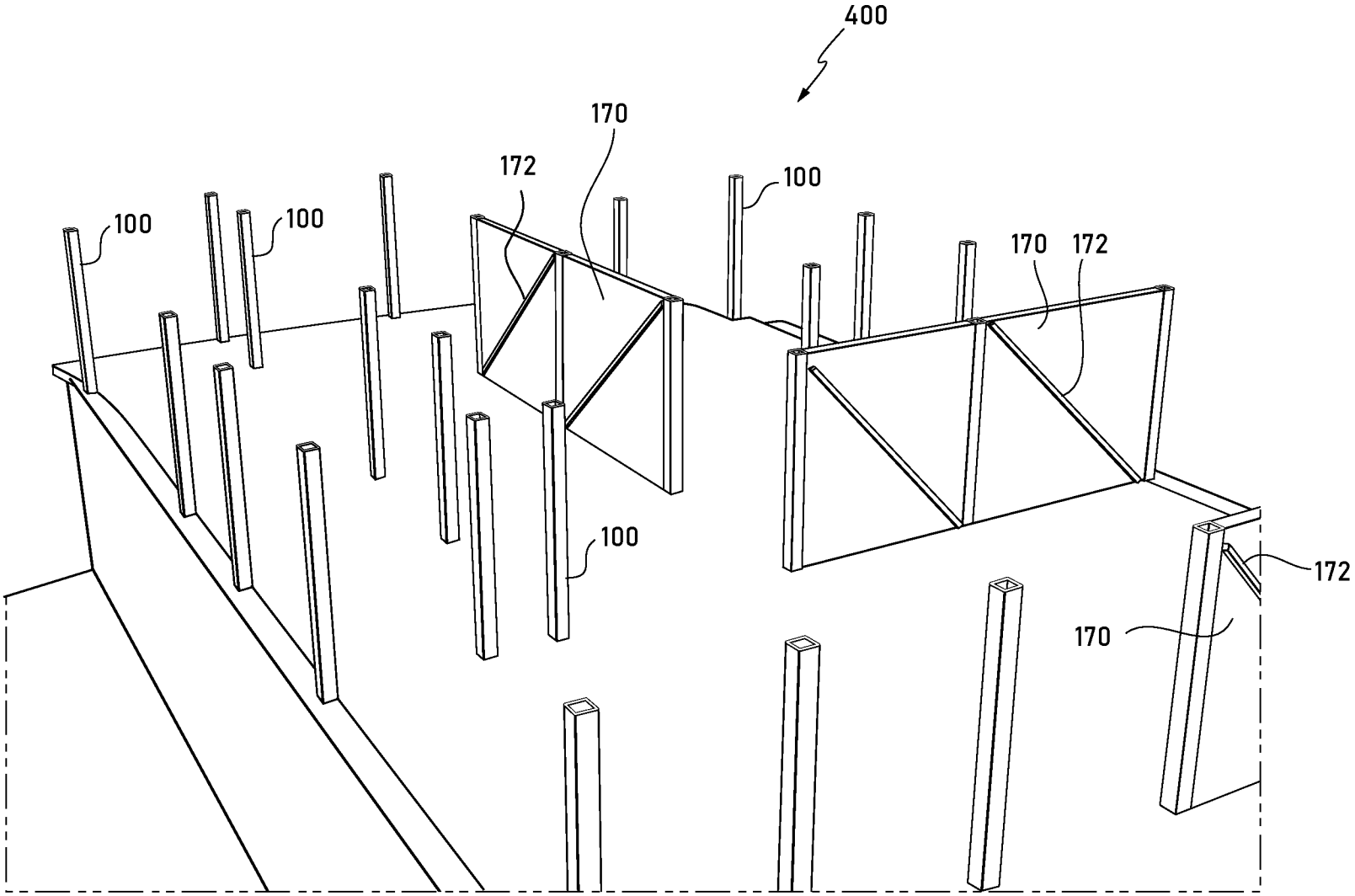
FIG. 14 shows ground floor posts and wall sections of a second embodiment of a building frame.

FIG. 14 shows ground floor posts (ie. column assemblies) 100 and wall sections 170 of the second embodiment of building frame 400. In at least some embodiments, wall sections 170 are produced in a factory with integral diagonal bracing 172. In some embodiments, bracing can be added between posts 100. However, this can block ease of access and passage between posts 100 during construction and is not preferred in some embodiments.

Figure 15:
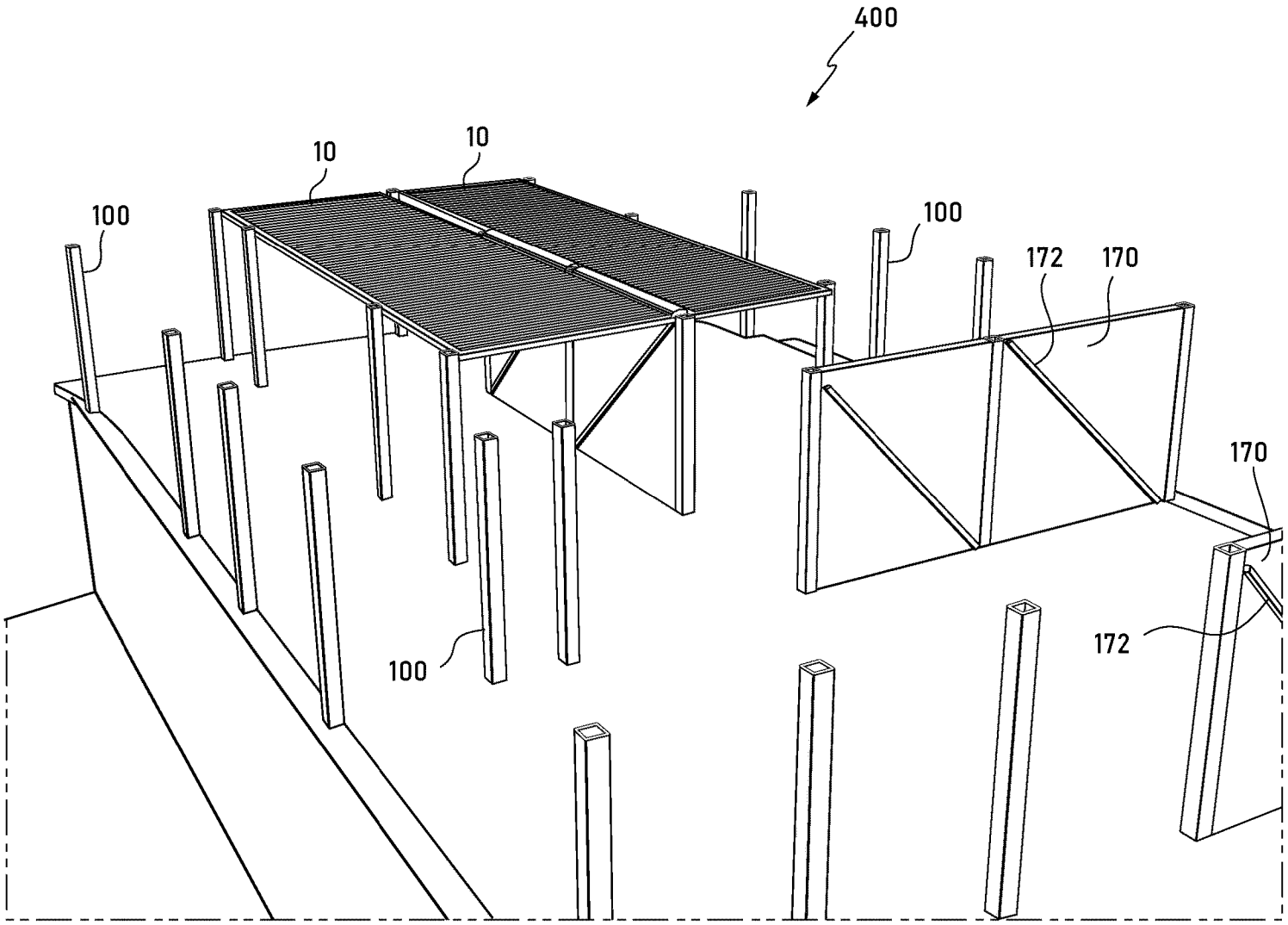
FIG. 15 shows initial trays added to the floor posts and wall sections of FIG. 14.
Figure 16:
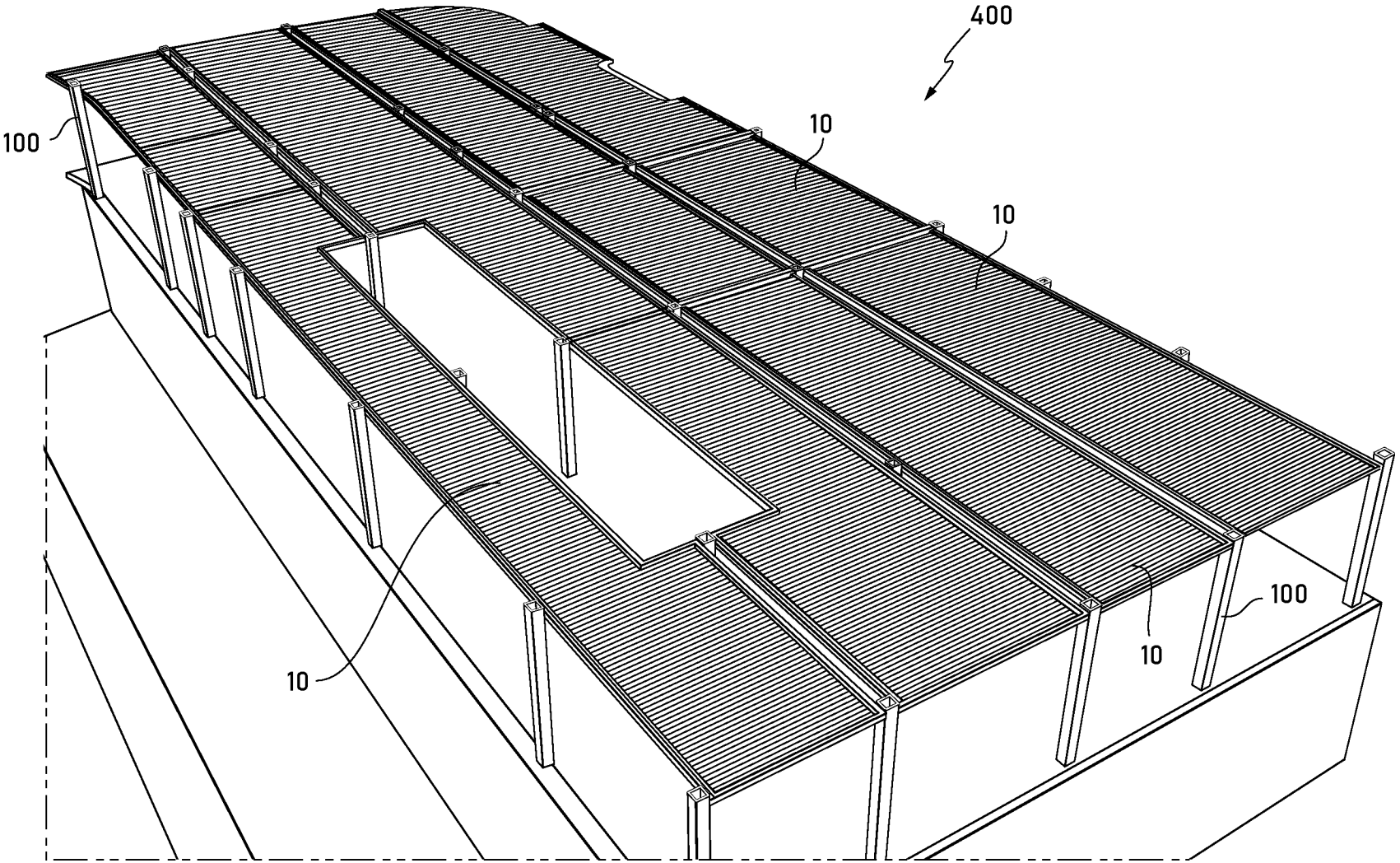
FIG. 16 shows completed trays added to the floor posts and wall sections of FIG. 15.

FIG. 15 shows two initial trays 10 added to floor posts 100 and wall sections 170 of FIG. 14. FIG. 16 shows the completed first floor after all remaining trays 100 are added. Gap 402 between trays 100 is for later addition of stairs and/or elevators.

Figure 17:
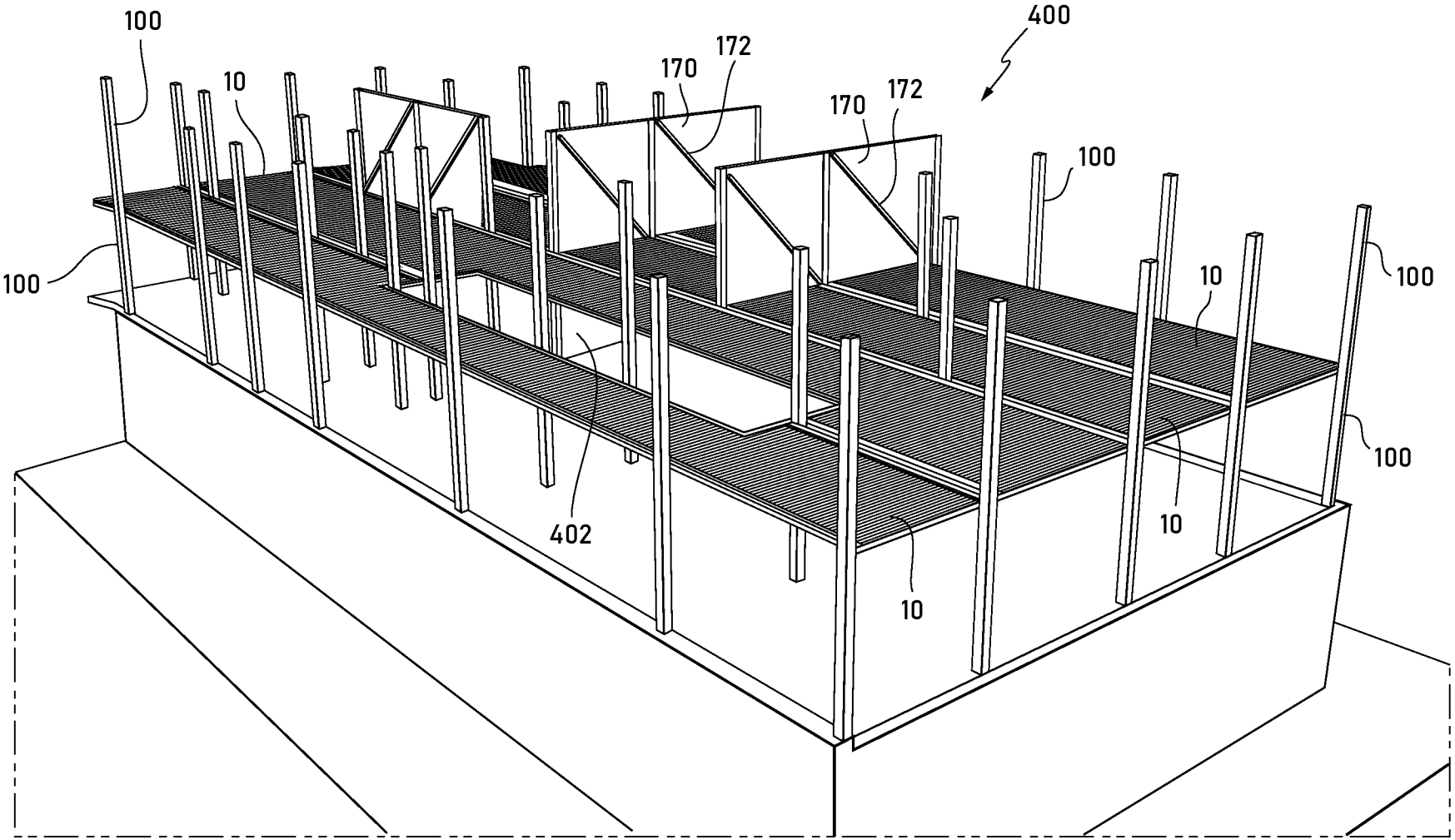
FIG. 17 shows first floor posts and wall sections added to the ground floor of FIG. 16.
Figure 18:
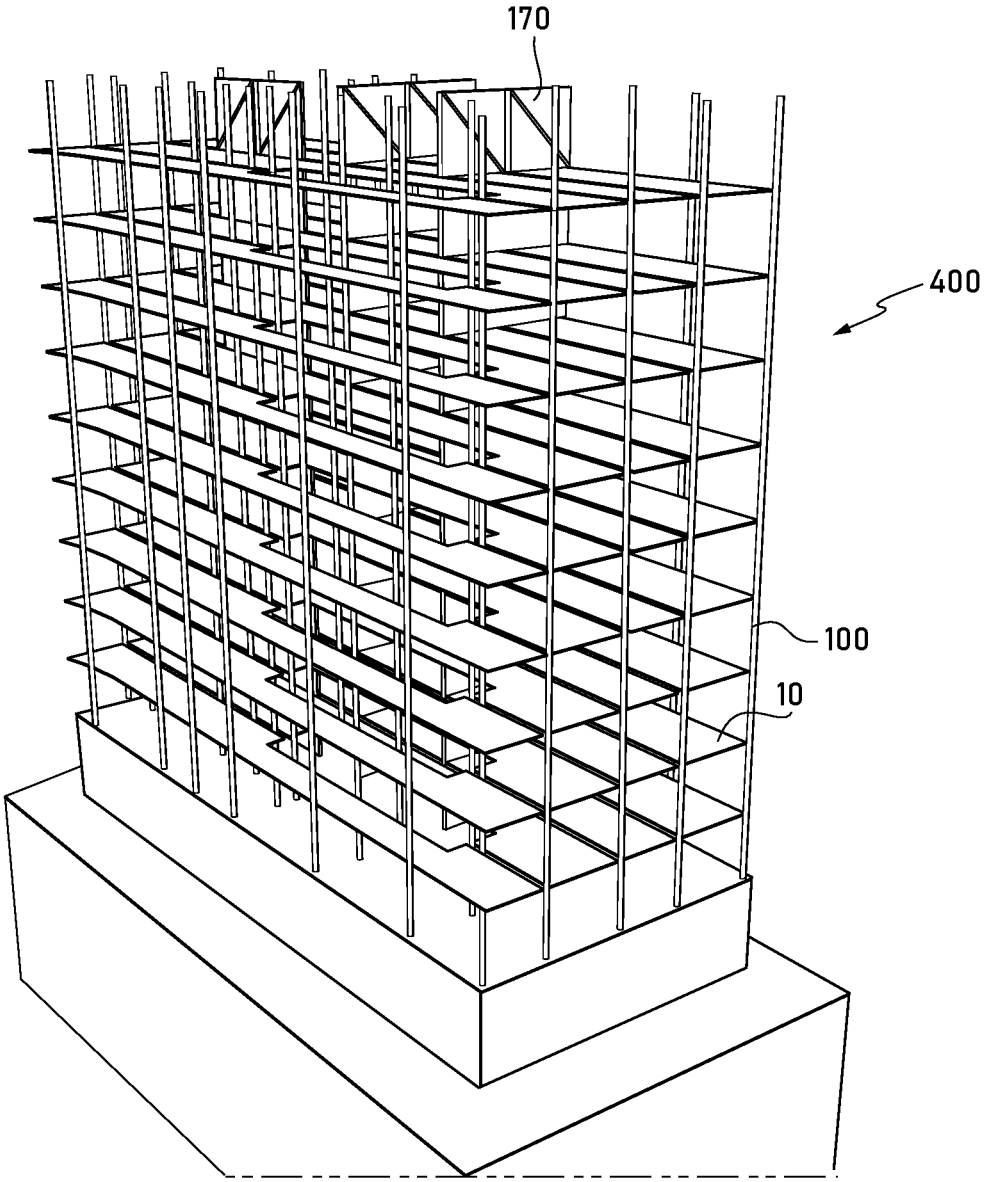
FIG. 18 shows second to tenth floors added to first floor of FIG. 17.

FIG. 17 shows first floor posts 100 and wall sections 170 added to the ground floor of FIG. 16 in a similar arrangement of the ground floor. FIG. 18 shows the similar addition of the second to tenth floors.

Figure 19:
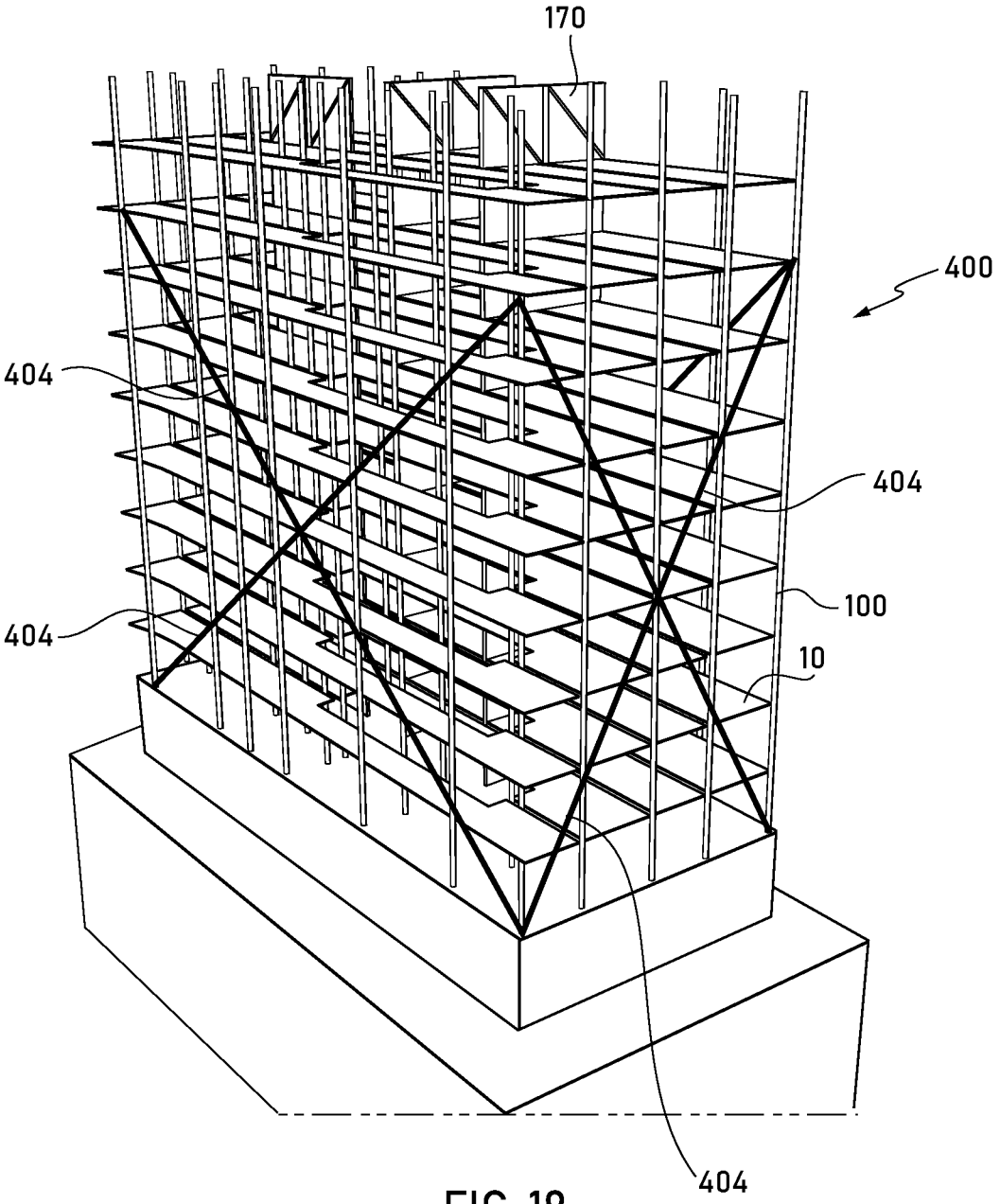
FIG. 19 shows external bracing added to the floors of FIG. 18.
Figure 20:
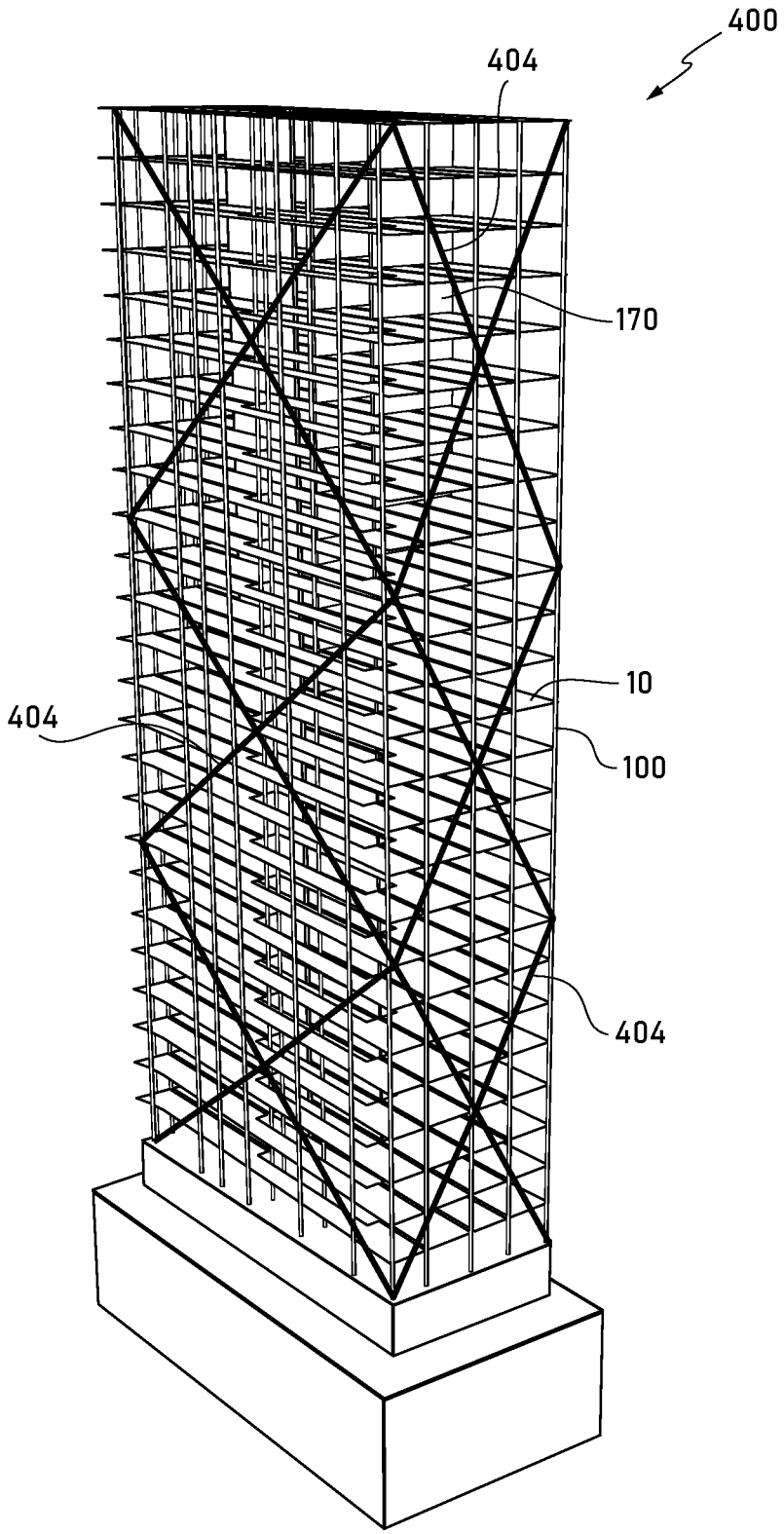
FIG. 20 shows eleventh to thirtieth floors added to the floors of FIG. 18, with additional external bracing.

FIG. 19 shows external bracing 404 added to the first ten floors. The bracing is in the form of post-tensioned strands which serve to resist building torsion and reduce movement during construction. FIG. 20 shows the eleventh to thirtieth floors added to the floors of FIG. 18, with additional similar external bracing.

Figure 21:
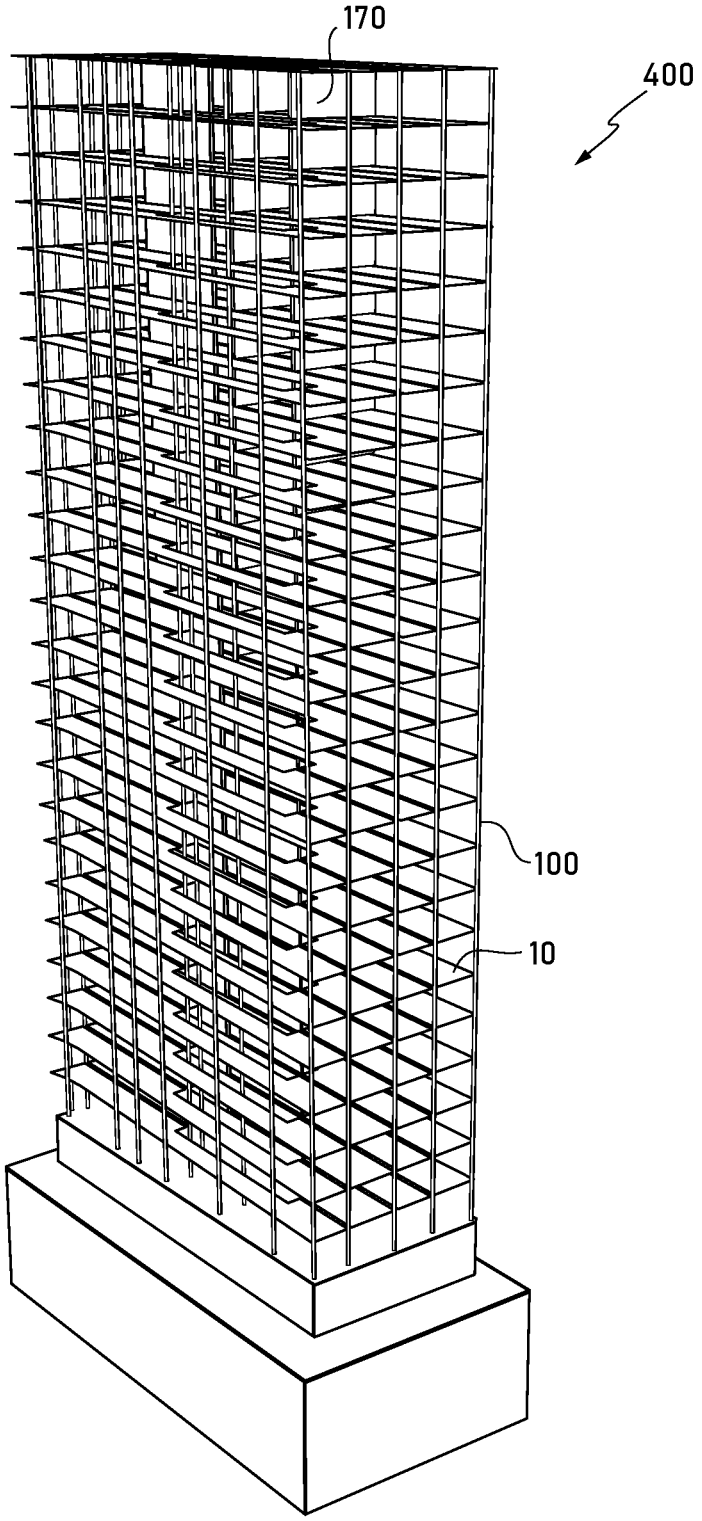
FIG. 21 shows the completed thirty floor second embodiment of building frame, with external bracing removed.

FIG. 21 shows the completed thirty floor second embodiment of building frame 400, with external bracing removed 404. In at least some embodiments, the removal of bracing 404 allows ease of access to the exterior of frame 400 for fitting external cladding and the like.

Although the invention has been described with reference to specific examples, it would be appreciated by those skilled in the art that the invention may be embodied in many other forms.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A method of constructing a modular building, said method comprising the following sequential steps:

(a) constructing a multi-floor building frame by connecting a plurality of like open topped-trays and a plurality of column assemblies, with said plurality of like open topped-trays forming floors and said plurality of column assemblies separating the floors;

(b) assembling walls or a walls formwork to said multi-floor building frame; and (c) pouring wet concrete into said open topped-trays on a plurality of floors and then allowing the concrete to cure to form said modular building, wherein said plurality of like open topped-trays are tensioned before being constructed into said multi-floor building frame so as to deform said plurality of like open topped-trays, whereafter the filling of said plurality of like open topped-trays with concrete flattens said plurality of like open topped-trays and induces post tensioning strengthening therein.

2. The method of constructing said modular building of claim 1, wherein said plurality of column assemblies are hollow and said wet concrete is also poured therethrough.

3. The method of constructing said modular building of claim 1, wherein said walls formwork are hollow and said wet concrete is also poured therethrough.

4. The method of constructing said modular building of claim 1, wherein a roof structure is assembled to said multi-floor building frame.

5. The method of constructing said modular building of claim 4, wherein said roof structure is assembled to said multi-floor building frame prior to the pouring of said wet concrete.

6. The method of constructing said modular building of claim 1, wherein said wet concrete is poured into each of said plurality of like open topped-trays and then allowed to cure.

7. The method of constructing said modular building of claim 1, wherein said wet concrete is poured into a first section of said plurality of like open topped-trays, wherein said first section of said plurality of like open topped-trays is allowed to cure, and then said wet concrete is poured into the remainder of said plurality of like open topped-trays, and wherein said remainder are allowed to cure.

8. The method of constructing said modular building of claim 1, wherein said wet concrete is poured into said plurality of like open topped-trays progressively, wherein said plurality of like open topped-trays are progressively allowed to cure.

9. The method of constructing said modular building of claim 1, wherein bracing is attached to the exterior of said modular building.

10. A method of constructing a modular building, said method comprising the following sequential steps:

(a) constructing a multi-floor building frame by connecting a plurality of like open topped-trays and a plurality of column assemblies, with said plurality of like open topped-trays forming floors and said plurality of column assemblies separating the floors;

(b) assembling walls or a walls formwork to said multi-floor building frame; and (c) pouring wet concrete into said plurality of like open topped-trays on a plurality of floors to form said modular building and allowing said wet concrete to cure, wherein said plurality of like open topped-trays are tensioned before being constructed into said multi-floor building frame so as to deform said plurality of like open topped-trays, whereafter the filling of said plurality of like open topped-trays with concrete flattens said plurality of like open topped-trays and induces post tensioning strengthening therein.

11. The method of constructing said modular building of claim 10, wherein said plurality of column assemblies are hollow and said wet concrete is also poured therethrough.

12. The method of constructing said modular building of claim 10, wherein said walls formwork are hollow and said wet concrete is also poured therethrough.

13. The method of constructing said modular building of claim 10, wherein a roof structure is assembled to said multi-floor building frame.

14. The method of constructing said modular building of claim 13, wherein said roof structure is assembled to said multi-floor building frame prior to the pouring of said wet concrete.

15. The method of constructing said modular building of claim 10, wherein bracing is attached to the exterior of said modular building.

16. The method of constructing said modular building of claim 11, wherein said walls formwork are hollow and said wet concrete is also poured therethrough.

17. The method of constructing said modular building of claim 16, wherein a roof structure is assembled to said multi-floor building frame.

* * * * *